US007083682B2

(12) United States Patent
DeVilbiss, III

(10) Patent No.: US 7,083,682 B2
(45) Date of Patent: Aug. 1, 2006

(54) METHOD AND ASSEMBLY FOR COATING ARTICLES

(75) Inventor: Thomas A. DeVilbiss, III, Rochester Hills, MI (US)

(73) Assignee: The Magni Group, Inc., Birmingham, MI (US)

( * ) Notice: Subject to any disclaimer, the term of this patent is extended or adjusted under 35 U.S.C. 154(b) by 0 days.

(21) Appl. No.: 10/949,515

(22) Filed: Sep. 24, 2004

(65) Prior Publication Data

US 2006/0065192 A1 Mar. 30, 2006

(51) Int. Cl.
*B05B 7/06* (2006.01)
*B05C 5/00* (2006.01)

(52) U.S. Cl. ..... 118/314; 118/320; 118/324

(58) Field of Classification Search ..... 118/313–316, 118/DIG. 11; 427/422, 424
See application file for complete search history.

(56) References Cited

U.S. PATENT DOCUMENTS 2,270,132 A * 1/1942 Malloy et al. ..... 118/321
3,279,421 A * 10/1966 Geoffrey et al. ..... 118/680
3,718,249 A * 2/1973 Hess ..... 198/822
5,240,745 A * 8/1993 Yamamoto et al. ..... 427/236
5,282,145 A * 1/1994 Lipson et al. ..... 700/208

* cited by examiner

*Primary Examiner*—Chris Fiorilla
*Assistant Examiner*—Yewebdar Tadesse
(74) *Attorney, Agent, or Firm*—Clark Hill PLC

(57) ABSTRACT

A coating assembly paints a coating on a plurality of articles having first and second article portions. The coating assembly includes a rail frame defining a longitudinal path for the plurality of articles to travel along. An endless chain having a chain portion thereof extending along the longitudinal path transports the plurality of articles along the longitudinal path. The coating assembly also includes a painting station for applying a coat of paint to the first article portion of each of the plurality of articles while preventing the coat of paint from extending to the second article portions of each of the plurality of articles. The painting station includes a plurality of spray nozzles fixedly secured to the rail frame on either side of the endless chain. Each of the plurality of spray nozzles are offset from each other along the longitudinal path such that the first article portions are entirely covered by the coat of paint as the plurality of articles pass thereby.

18 Claims, 3 Drawing Sheets

METHOD AND ASSEMBLY FOR COATING ARTICLES

BACKGROUND ART

1. Field of the Invention

The invention relates generally to assemblies used to coat articles of manufacture. More specifically, the invention relates to a coating assembly that accurately paints a portion of articles of manufacture.

2. Description of the Related Art

It is quite common for articles of manufacture to be coated with a material. These coatings may be decorative. In many instances, these coatings are required to ensure the long life of the article being manufactured. The coatings may provide enhanced frictional properties that will reduce the wear of a particular article. Other coatings prevent the surface of the article from reacting to elements in the environment in which the article is placed. These reactions tend to be considered corrosive in nature, e.g., oxidation.

Some articles are designed such that they require multiple coatings over different portions thereof. One such article is a ball stud, typically used in the manufacture of automobiles and other machinery. The ball stud includes a steel ball with a threaded stud extending out therefrom. In many applications, the ball is going to be surrounded by a lubricant and does not require additional coatings to protect it. The stud portion of the ball stud is not, however, exposed to the lubricants. This portion of the article will require coatings to prevent the corrosion thereof. Currently, the practice of coating the stud portion of the ball stud is done through a dip spinning process. In this process, the ball studs are lowered into a bath and then spun to remove the excess material off the stud. This process is inferior because it requires a large amount of coating material to produce the coated articles. Additionally, the coating on the article, in this case, the stud, is thicker than it needs to be. This results in excess costs associated with increased material consumption, as well as decreased tolerances in the finished product. And finally, the dip spin process is an inaccurate process in that portions of the coating material splatter up onto the ball portion of the ball stud. This splatter detracts from the performance of the ball stud creating the necessity for increased man hours to clean the ball studs once they have been coated.

SUMMARY OF THE INVENTION

A coating assembly paints a coating on a plurality of articles having first and second article portions. The coating assembly includes a rail frame defining a longitudinal path for the plurality of articles to travel along. An endless chain having a chain portion thereof extending along the longitudinal path transports the plurality of articles along the longitudinal path. The coating assembly also includes a painting station for applying a coat of paint to the first article portion of each of the plurality of articles while preventing the coat of paint from extending to the second article portions of each of the plurality of articles. The painting station includes a plurality of spray nozzles fixedly secured to the rail frame on either side of the endless chain. Each of the plurality of spray nozzles are offset from each other along the longitudinal path such that the first article portions are entirely covered by the coat of paint as the plurality of articles pass thereby.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
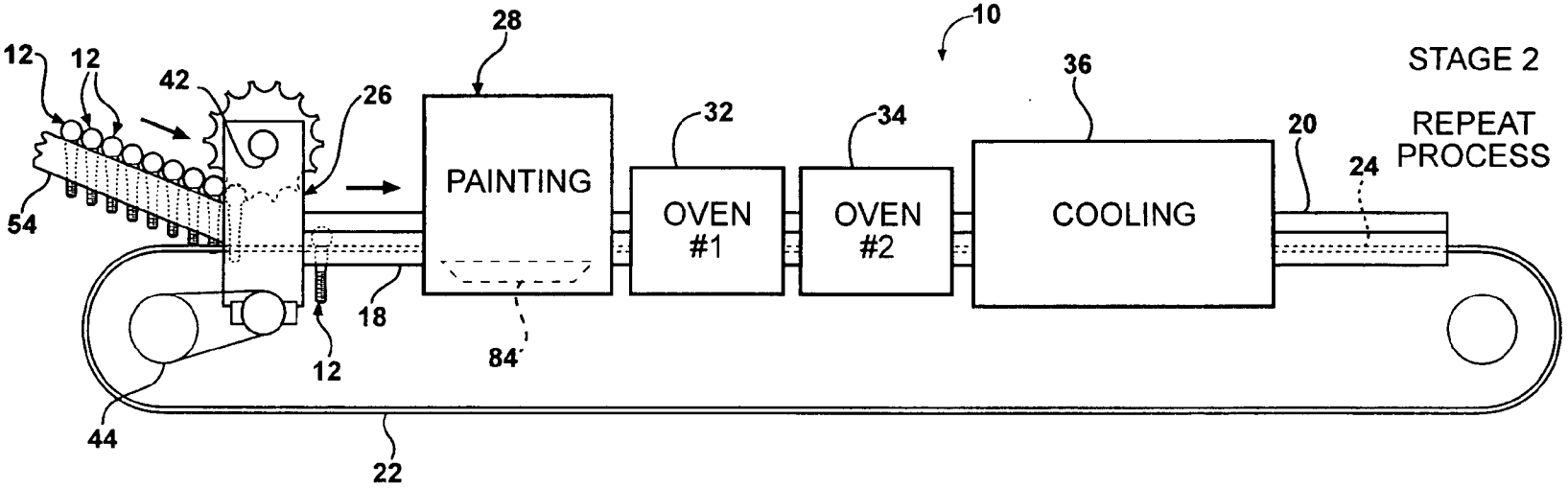
FIG. 1 is a schematic plan view of one embodiment of the invention.

Referring to FIG. 1, a schematic, plan view representation of the inventive coating assembly is generally indicated at 10. The coating assembly 10 is designed to coat articles 12. In the preferred embodiment, the coating assembly 10 is coating ball studs 12. It should be appreciated by those skilled in the art that the coating assembly 10 may be utilized for other articles 12 other than ball studs.

Figure 3:
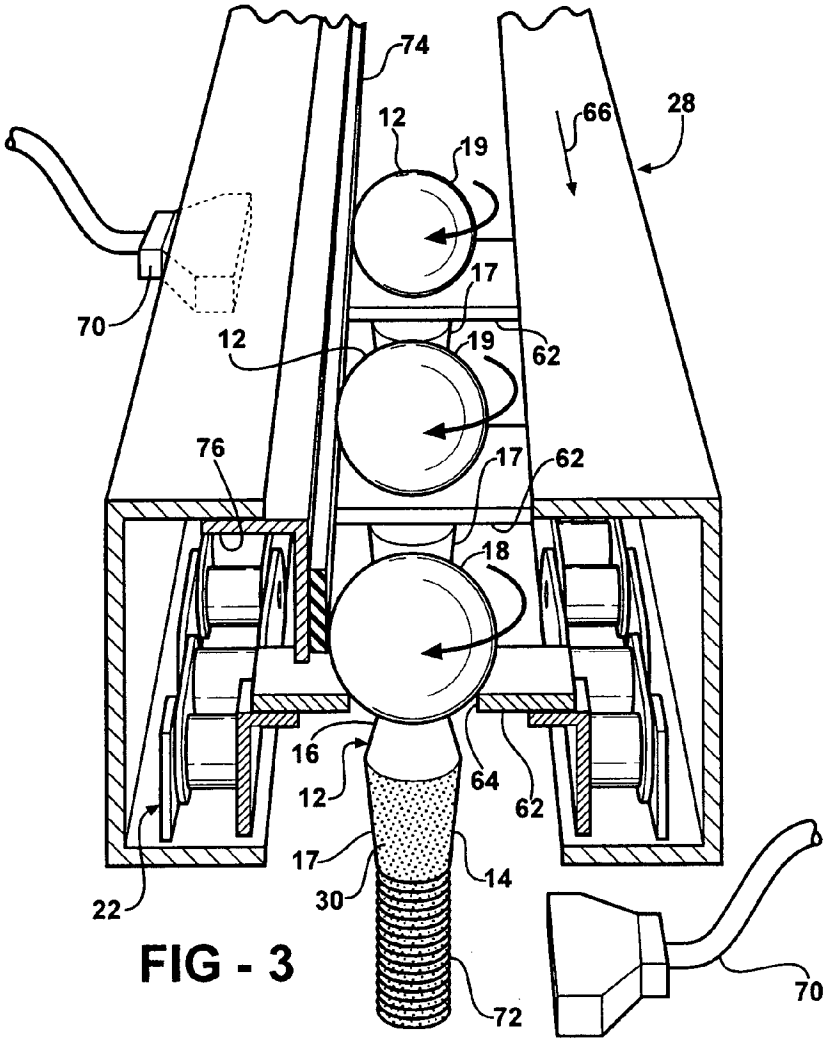
FIG. 3 is a perspective end view, cut away, of a terminal end of a paint station for the invention.

The coating assembly 10 coats a portion of the ball studs 12. Referring to FIG. 3, a ball stud 12 is shown having a first article portion 14 and a second article portion 16 which includes a portion of a stud 17 and a ball 19 fixedly secured thereto. It is the first article portion 14 that is coated by the coating assembly 10.

Referring back to FIG. 1, the coating assembly 10 includes a rail frame 18. The rail frame 18 is a structure that defines a longitudinal path 20 along which the articles 12 pass during the coating process. The rail frame 18 includes a frame structure (not shown) that raises the coating assembly 10 up off the ground. The frame structure is not shown for purposes of simplicity.

An endless chain 22 extends around the rail frame 18. More specifically, the endless chain 22 is a continuous loop of chain. The endless chain 22 includes a chain portion 24, shown in phantom in FIG. 1, that extends along the longitudinal path 20 of the rail frame 18. While the chain portion 24 is referred to as a discrete portion of the endless chain 22, it should be appreciated that the chain portion 24 is continuously changing due to the constant revolutions of the endless chain 22 about the rail frame 18. The endless chain 22 transports the plurality of articles 12 along the longitudinal path 20.

The coating assembly 10 includes an indexer, generally shown at 26, that indexes the articles 12 as they are introduced into the endless chain 22. The indexer 26 will be discussed in greater detail subsequently.

Once loaded onto the endless chain 22, the articles 12 then proceed into a painting station, generally indicated at 28, where a coating 30 (FIG. 3) is applied to the first article portion 14 of the article 12. Again, the painting station 28 will be discussed in greater detail subsequently. Once the articles 12 are painted, they pass along the longitudinal path 20 to a first oven 32. The first oven 32 flashes the articles 12. The first oven 32 has an increased temperature that flashes the coating 30 on the articles 12 to remove the solvent out of the coating 30. Once the coatings 30 on the articles 12 are flashed, the articles 12 are then moved into a second oven 34. The second oven 34 cures the coating 30 to the articles 12.

Once the coatings 30 are cured in the second oven 34, the articles 12 pass through a cooling stage 36. The cooling stage 36 may be merely an open portion of the rail frame 18. In the embodiment shown in FIG. 1, the cooling stage 36 is an enclosed portion of the rail frame 18 wherein the temperature of the cooling stage 36 may be controlled to a level below ambient temperature.

Once the articles 12 are cooled to a desired temperature, the process that was just described is repeated. Namely, the articles 12 are coated with a coating 30 that covers the original coating 30. The coatings 30 are then flashed in a first oven, cured in a second oven and cooled through a cooling stage. Once the second stage is complete, the articles 12 are removed from the coating assembly 10 and packaged for subsequent incorporation into a manufactured product. The purpose for the second stage of coating is to allow the articles 12 to be coated using the Magni 565 paint system, which is a proprietary paint system produced by the assignee of this patent application. It should be appreciated by those skilled in the art that the second stage may not be required to use the inventive method and/or assembly. This is because the coating assembly 10 is designed to utilize any type of paint system, regardless of the number of stages that are required to complete the paint process.

Figure 2:
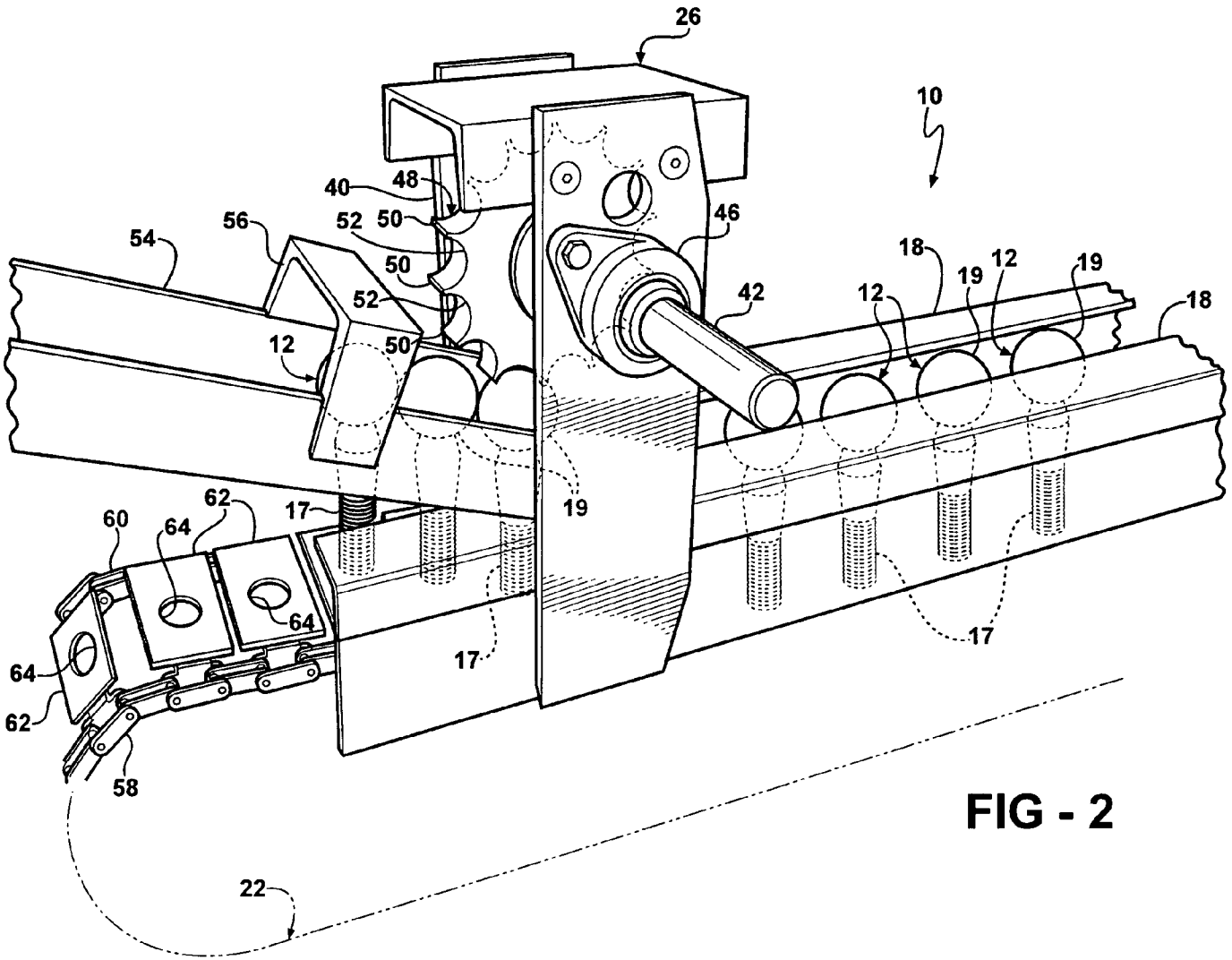
FIG. 2 is a cut away portion of an indexer utilized by the invention.

Referring to FIG. 2, the indexer 26 is shown in greater detail. The indexer 26 includes two sides 38, 40 that mount to the rail frame 18. A shaft 42 extends between the two sides 38, 40 of the indexer 26. The shaft 42 extends beyond the first side 38 so that it can be driven by a motor 44 (FIG. 1), that also drives the endless chain 22. By having the motor 44 drive both the endless chain 22 and the shaft 42 of the indexer 26, there is minimal timing requirements to ensure that the indexer 26 moves with the endless chain 22. A bearing housing 46 is mounted to each of the sides 38, 40 to facilitate the rotation of the shaft 42 with respect to the sides 38, 40.

The indexer 26 includes a sprocket, generally indicated at 48. The sprocket 48 includes a plurality of teeth 50. Each of the plurality of teeth 50 define an engagement wall 52. The engagement walls 52 engage and guide each of the plurality of articles 12 until they are received by the endless chain 22.

The indexer 26 also includes a loading rail 54. The loading rail 54 holds all of the articles 12 before they are received by the endless chain 22. The loading rail 54 includes a support structure 56 that extends across the loading rail. The loading rail 54 also includes a channel (not shown) that allows the first article portion 14, i.e., the threaded stud 17 of the ball stud 12, to extend down below the loading rail 54. The loading rail is disposed at an angle with respect to the rail frame 18. The loading rail 54 extends at a 45° angle with regard to the rail frame 18. This allows the articles 12 to be lowered down to the endless chain 22 using the mass of each of the articles 12 to be acted upon by gravity to force them downwardly toward the endless chain 22.

The endless chain 22 is a modified chain assembly. The endless chain 22 includes a first chain side 58 and a second chain side 60. The first 58 and second 60 chain sides are connected together by a plurality of receiving plates 62. The chain sides 58, 60 and the receiving plates 62 all move in unison with no lost motion therebetween. Each of the receiving plates 62 includes an aperture 64. The aperture 64 is designed to allow the first article portion 14 therethrough to allow the ball 19 of the article 12 to nest securely on the receiving plate 62. The receiving plate 62 is the vehicle used to transport the articles 12 through the coating assembly 10 along the longitudinal path 12.

Figure 4:
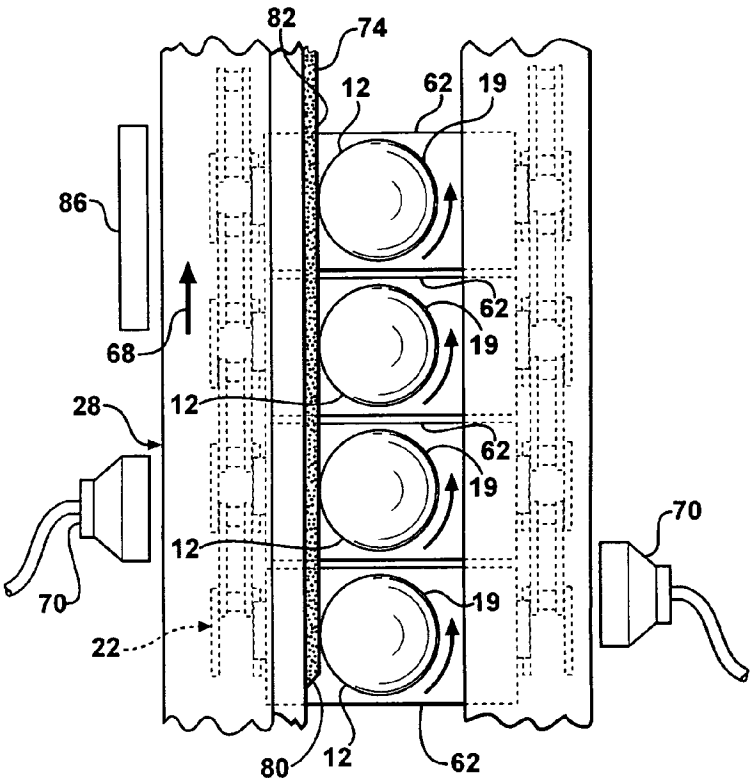
FIG. 4 is a cut away top view of the paint station of the invention.

Referring to FIGS. 3 and 4, two views of the painting station 28 are shown. FIG. 3 is a perspective view, cut away, showing ball studs 12 as they are coming out of the painting station 28. Therefore, this view represents the ball studs 12 moving in the direction of arrow 66 away from the indexer 26. Whereas, FIG. 4 is a representation of the ball studs 12 moving in a direction represented by arrow 68 as the ball studs 12 pass through the painting station 28.

A plurality of spray nozzles 70 are fixedly secured to the rail frame 18 on either side of the endless chain 22. The spray nozzles 70 are also offset from each other along the longitudinal path 20, best represented in FIG. 4. In this manner, the spray nozzles 70 spray different ball studs 12 at any given time. It should be appreciated by those skilled in the art that although there are only two spray nozzles 70 shown, any number of spray nozzles 70 may be utilized given the type of article being coated. In addition, it should be appreciated that the spray nozzle 70 may spray the same article at the same time, given the size of the article being sprayed. It is, however, important to note that the spray nozzles 70 must be positioned to be offset from each other a specific distance such that they do not spray the same portion of the article 12 that was sprayed by the previous spray nozzle 70. This is accomplished by understanding the speed in which the ball studs 12 are moving along the longitudinal path 20. The spray nozzles 70 spray, graphically represented in FIG. 3, a coating 72 that coats the first article portion 14 of the ball stud 12.

The painting station 28 also includes a rotational bumper 74. The rotational bumper 74 extends along the longitudinal path 20 above the chain portion 24 of the endless chain 22. The rotational bumper 74 is mounted to one side of the rail frame 18 using an angle mount 76. The angle mount 76 is designed such that the rotational bumpers 74 will be contacted by a ball portion 19 of the ball studs 12. The mild contact between the ball portion 78 and the rotational bumper 74 forces each of the ball studs 12 to rotate as they pass through the painting station 28. This helps ensure that the entire circumference of the first article portion 14 is covered by the spray coating 72 to create the coating 30 extending around the first article portion 14. The rotational bumper 74 includes a chamfered front surface 80 and an abutting surface 82.

Referring back to FIG. 1, the painting station 28 also includes a collection tray 84 that collects the spray coating 72 that does not affix itself to the first article portion 14 of the ball studs 12. The collected spray coating 72 is recycles and resprayed onto the ball studs 12. To aid in the process of removing excess spray coating 72 from the first article portion 14, an air knife 86 pushes air over the first article portions 14 as they rotate therepast. The air forces any excess spray coating 72 to drop off the first article portion into the collection tray 84. (Tad, please draw the air knife in the appropriate position in FIGS. 3 and/or 4. Thanks.)

In operation, the articles or ball studs 12 are loaded into the loading rail 54. When the motor 44 is started, the indexer 26 feeds the ball studs 12 into the chain portion 24 of the endless chain. The first article portions 14 of the ball studs 12 fall through the apertures 64 in the receiving plate 62 of the endless chain 22 and are moved along the longitudinal path 20. The ball studs 12 are painted in the painting station 28, flashed in the first oven 32, cured in the second oven 34 and cooled in the cooling stage 36. If required, the process is repeated at stage 2. After completion of stage 2, the ball studs 12 are removed from the endless chain 22.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed:

1. A coating assembly for painting a coating on a plurality of articles having first and second article portions, said coating assembly comprising:

a rail frame defining a longitudinal path for the plurality of articles to travel along;

an endless chain having a chain portion thereof extending along said longitudinal path, said endless chain transporting the plurality of articles along said longitudinal path; and a painting station for applying a coat of paint to the first article portion of each of the plurality of articles while preventing said coat of paint from extending to the second article portions of each of the plurality of articles, said painting station including a rotational bumper and a plurality of spray nozzles fixedly secured to said rail frame on either side of said endless chain, said rotational bumper rotates each of the plurality of articles as they travel past each of said plurality of spray nozzles, and each of said plurality of spray nozzles offset from each other along said longitudinal path such that the first article portion is entirely covered by said coat of paint as the plurality of articles pass thereby.

2. A coating assembly as set forth in claim 1 wherein said rotational bumper extends along said longitudinal path above said chain portion of said endless chain.

3. A coating assembly as set forth in claim 2 including an indexer for positioning each of the plurality of articles to be received by said endless chain in a uniformly spaced manner.

4. A coating assembly as set forth in claim 3 wherein said endless chain includes a plurality of receiving plates wherein each of said plurality of articles is held by each of said plurality of receiving plates as the plurality of articles pass through said conveyor assembly.

5. A coating assembly as set forth in claim 4 wherein each of said plurality of receiving plates includes an aperture for receiving said plurality of articles therethrough.

6. A coating assembly as set forth in claim 3 wherein said indexer includes a sprocket defining a plurality of teeth.

7. A coating assembly as set forth in claim 6 wherein each of said plurality of teeth define an engagement wall for engaging and guiding each of the plurality of articles.

8. A coating assembly as set forth in claim 7 including a loading rail fixedly secured to said indexer for loading the plurality of articles into said indexer.

9. A coating assembly as set forth in claim 8 wherein said loading rail is oriented at about 45° from said longitudinal path of said rail frame.

10. A coating assembly as set forth in claim 9 including a motor for driving said endless chain about said rail frame.

11. A coating assembly as set forth in claim 10 including a synchronizing link extending between said motor and said indexer to synchronize said indexer with said endless chain as said endless chain moves.

12. A coating assembly for painting a coating on a plurality of articles having first and second article portions, said coating assembly comprising:

a rail frame defining a longitudinal path for the plurality of articles to travel along;

an endless chain having a chain portion thereof extending along said longitudinal path, said endless chain transporting the plurality of articles along said longitudinal path, said endless chain including a plurality of receiving plates wherein each of the plurality of articles is held by each of said plurality of receiving plates as the plurality of articles pass through said coating assembly; and a painting station for applying a coat of paint to the first article portion of each of the plurality of articles while preventing said coat of paint from extending to the second article portions of each of the plurality of articles, said painting station including a plurality of spray nozzles fixedly secured to said rail frame on either side of said endless chain, each of said plurality of spray nozzles offset from each other along said longitudinal path such that the first article portion is entirely covered by said coat of paint as the plurality of articles pass thereby; and an indexer for positioning each of the plurality of articles to be received by said endless chain in a uniformly spaced manner.

13. A coating assembly as set forth in claim 12 wherein said indexer includes a sprocket defining a plurality of teeth.

14. A coating assembly as set forth in claim 13 wherein each of said plurality of teeth define an engagement wall for engaging and guiding each of the plurality of articles.

15. A coating assembly as set forth in claim 14 including a loading rail fixedly secured to said indexer for loading the plurality of articles into said indexer.

16. A coating assembly as set forth in claim 15 wherein said painting station includes a rotational bumper to rotate each of the plurality of articles as they travel past each of said plurality of spray nozzles.

17. A coating assembly as set forth in claim 16 wherein said rotational bumper extends along said longitudinal path above said chain portion of said endless chain.

18. A coating assembly as set forth in claim 17 wherein said loading rail is oriented at about 45° from said longitudinal path of said rail frame.

* * * * *